US009403655B2

(12) United States Patent
Kotani

(10) Patent No.: US 9,403,655 B2
(45) Date of Patent: Aug. 2, 2016

(54) POST-PROCESSING DEVICE HAVING SHIFTED SHEETS

(71) Applicant: KYOCERA Document Solutions Inc., Osaka (JP)

(72) Inventor: Takashi Kotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/755,762

(22) Filed: Jun. 30, 2015

(65) Prior Publication Data

US 2016/0002001 A1 Jan. 7, 2016

(30) Foreign Application Priority Data

Jul. 2, 2014 (JP) ..... 2014-136730

(51) Int. Cl.

| | |
|---|---|
| ***B65H 37/04*** | (2006.01) |
| ***B65H 31/34*** | (2006.01) |
| ***B65H 29/51*** | (2006.01) |
| ***B65H 31/30*** | (2006.01) |

(52) U.S. Cl.

CPC ..... *B65H 31/34* (2013.01); *B65H 29/51* (2013.01); *B65H 31/3027* (2013.01); *B65H 2301/4213* (2013.01); *B65H 2301/42194* (2013.01); *B65H 2401/111* (2013.01); *B65H 2404/1441* (2013.01); *B65H 2801/27* (2013.01)

(58) Field of Classification Search

CPC ..... B65H 37/04

USPC ..... 270/58.07, 58.08, 58.09, 58.11, 58.16, 270/58.17, 32, 37, 39.08

See application file for complete search history.

(56) References Cited

U.S. PATENT DOCUMENTS

| | | | | |
|---|---|---|---|---|
| 2007/0045929 | A1* | 3/2007 | Fujii | B65H 29/51 270/58.14 |
| 2013/0043636 | A1* | 2/2013 | Gamo | B42C 1/12 270/58.07 |
| 2014/0061994 | A1* | 3/2014 | Mimura | B65H 29/14 270/58.09 |

FOREIGN PATENT DOCUMENTS

| | | |
|---|---|---|
| JP | H10-181988 A | 7/1998 |

* cited by examiner

*Primary Examiner* — Patrick Mackey
(74) *Attorney, Agent, or Firm* — Studebaker & Brackett PC

(57) ABSTRACT

A sheet post-processing device includes a tray, an evacuating member, a regulating member mounted on the tray, and a feed mechanism. The tray can receive sheets thereon. The evacuating member temporarily evacuates, from a conveyance path, sheets being conveyed, stacks the evacuated sheets into a pile, and conveys the pile of sheets onto the tray through the conveyance path. The feed mechanism includes a spongy elastic member and moves the pile of sheets along the tray toward the regulating member. When stacking three or more sheets into a pile, the evacuating member performs the stacking such that, in the pile conveyed to the tray, an edge of each intermediate sheet protrudes toward the regulating member beyond an edge of an uppermost sheet and an edge of a lowermost sheet.

7 Claims, 8 Drawing Sheets

POST-PROCESSING DEVICE HAVING SHIFTED SHEETS

INCORPORATION BY REFERENCE

The present application claims priority under 35 U.S.C. §119 to Japanese Patent Application No. 2014-136730, filed Jul. 2, 2014. The contents of this application are incorporated herein by reference in their entirety.

BACKGROUND

The present disclosure relates to sheet post-processing devices and image forming apparatuses.

More and more recent image forming apparatuses such as copiers and multifunction peripherals are equipped with a sheet post-processing device, such as a finisher, for performing post-processing of sheets, such as stapling of sheets. A sheet post-processing device sequentially receives sheets having been printed by the main body of an image forming apparatus. To staple printed sheets, a conveyance section of the sheet post-processing device conveys the printed sheets to a processing tray provided within the sheet post-processing device. After conveying the sheets to the processing tray, the sheet post-processing device moves the sheets using a paddle along the processing tray toward a regulating member that is mounted on one end of the processing tray. In the manner described above, the sheets stacked on the processing tray are aligned at the edges thereof. The sheet post-processing device then staples the thus aligned sheets.

Until the sheets on the processing tray are stapled and conveyed to the exit port, subsequent sheets to be stapled cannot be conveyed to the processing tray. The sheet post-processing device is therefore provided with an evacuating member. During the time until the stapled sheets are conveyed from the processing tray to the exit port, the evacuating member evacuates, from the conveyance section, sheets sequentially fed from the image forming apparatus. The sheets evacuated by the evacuating member are stacked into a pile and held in standby. The pile of evacuated sheets is conveyed through the conveyance section onto the processing tray after the stapled sheets are conveyed from the processing tray to the exit port.

However, when three sheets are stacked into a pile, moving the pile toward the regulating member using a paddle may fail to ensure that the edges of the uppermost, lowermost, and intermediate sheets reach the regulating member. Thus, the edges of the three sheets may remain unaligned. One solution disclosed to address the problem noted above involves stacking three sheets into a pile such that, in a state where the pile is conveyed onto the processing tray and not yet moved toward the regulating member, the edge of each sheet protrudes toward the regulating member beyond the edge of an immediately lower sheet.

SUMMARY

A sheet post-processing device according to the present disclosure includes a tray, an evacuating member, a regulating member, and a feed mechanism. The tray can receive sheets thereon. The evacuating member temporarily evacuates, from a conveyance path, sheets being conveyed, stacks the evacuated sheets into a pile, and conveys the pile of sheets onto the tray through the conveyance path. The regulating member is mounted on the tray. The feed mechanism includes a spongy elastic member. The feed mechanism moves the pile of sheets along the tray toward the regulating member. When stacking three or more sheets into a pile, the evacuating member performs the stacking such that, in the pile conveyed to the tray, an edge of each intermediate sheet protrudes toward the regulating member beyond an edge of an uppermost sheet and an edge of a lowermost sheet.

An image forming apparatus according to the present disclosure includes a main body for printing an image on one or more sheets, and the sheet post-processing device described above. The main body feeds sheets requested to be fed to the sheet post-processing device from among the one or more printed sheets.

DETAILED DESCRIPTION

With reference to the accompanying drawings, the following describes an embodiment of a sheet post-processing device and an image forming apparatus according to the present disclosure. Throughout the drawings, the same or corresponding parts are denoted by the same reference signs, and no overlapping description is given.

Embodiment 1

Figure 1:
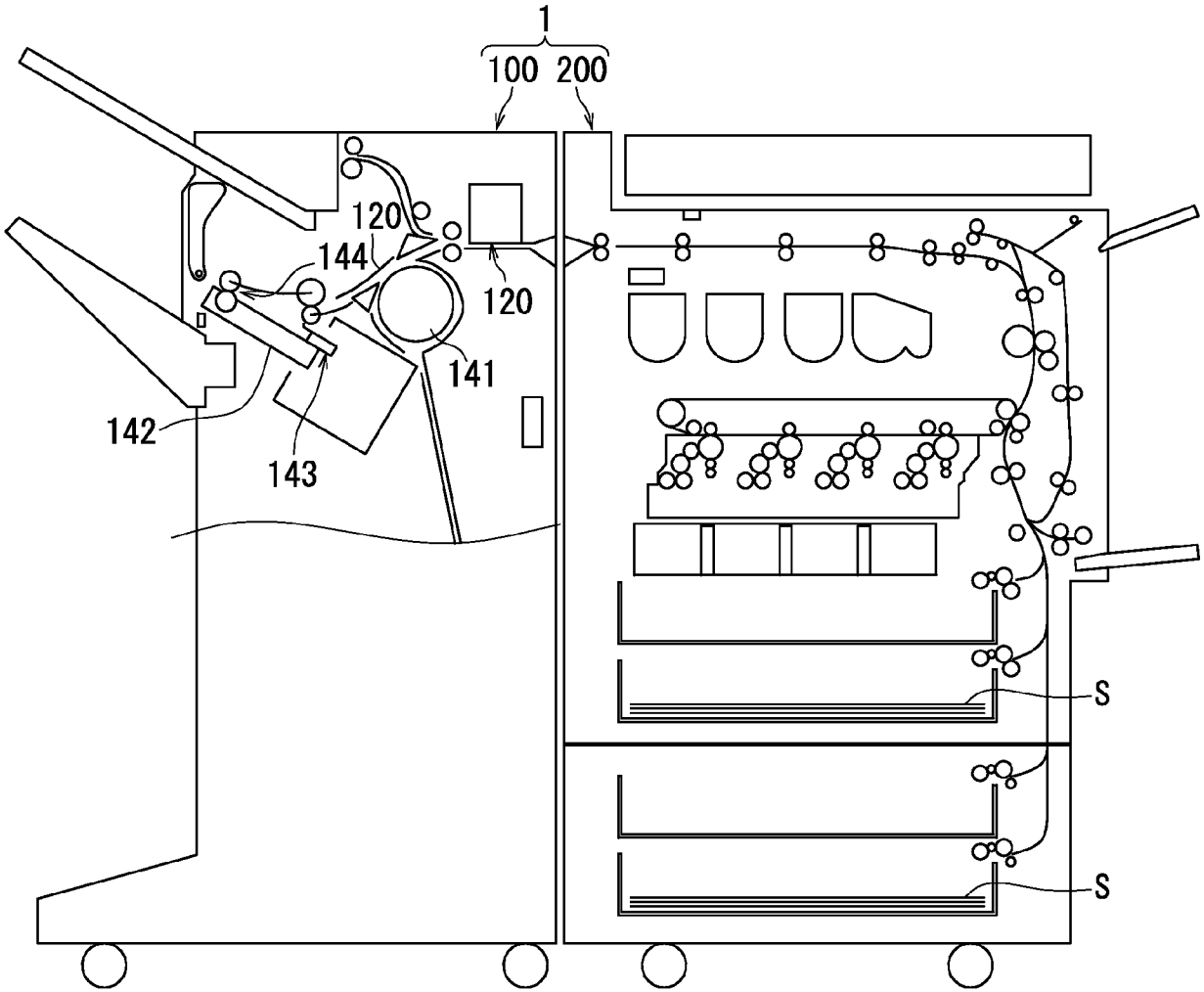
FIG. 1 is a schematic diagram of an image forming apparatus according to embodiments of the present disclosure.

FIG. 1 is a schematic diagram of an image forming apparatus according to Embodiment 1 of the present disclosure. The image forming apparatus 1 according to the present embodiment is a copier.

As shown in FIG. 1, the image forming apparatus 1 includes a sheet post-processing device 100 and a main body 200 that is for printing an image on a sheet S. The sheet post-processing device 100 performs post-processing, such as stapling, of sheets S fed from the main body 200 after printing on the sheets S. The sheet post-processing device 100 includes a conveyance section 120, an evacuating member 141, a processing tray 142, a regulating member 143, and at least one feed roller pair 144. In the present embodiment, a sheet S is a sheet of paper.

The conveyance section 120 sequentially conveys printed sheets S fed from the main body 200.

The processing tray 142 can receive a plurality of sheets S thereon. The regulating member 143 is mounted on one end of the processing tray 142. The processing tray 142 is inclined such that sheets S conveyed on the processing tray 142 slide toward the regulating member 143 under their own weight.

The evacuating member 141 is a cylindrical rotary body that is driven to rotate by a driving mechanism such as a motor. The evacuating member 141 temporarily evacuates sheets S one by one from the conveyance section 120 as the sheets S are conveyed by the conveyance section 120 toward the processing tray 142. The evacuating member 141 can stack sheets S evacuated from the conveyance section 120 into a pile. The conveyance section 120 conveys the sheets S stacked into a pile by the evacuating member 141 onto the processing tray 142. The feed roller pair 144 serving as a feed mechanism can move the pile of sheets along the processing tray 142 toward the regulating member 143. Each roller in the feed roller pair 144 is a spongy elastic member.

When stacking three or more sheets S into a pile, the evacuating member 141 performs the stacking such that, once the pile is moved to the processing tray 142, an edge of each intermediate sheet S protrudes toward the regulating member 143 beyond the edges of the uppermost and lowermost sheets S. The uppermost sheet S refers to a sheet S at the top of the pile on the processing tray 142. The lowermost sheet S refers to a sheet S at the bottom of the pile on the processing tray 142. An intermediate sheet S refers to a sheet S located between the uppermost sheet S and the lowermost sheet S among the three or more sheets in the pile.

Since a pile of sheets S stacked in the manner described above is conveyed to the processing tray 142, the feed roller pair 144 can move the pile so as to ensure that an edge of each sheet S reaches the regulating member 143 even if the pile includes three or more sheets S. Consequently, the edges of the respective sheets S in the pile are aligned as detailed below.

The uppermost and lowermost sheets S in a pile receive force directly from the feed roller pair 144. Therefore, the uppermost and lowermost sheets S are moved until their edges reach the regulating member 143. On the other hand, intermediate sheets S do not receive force directly from the feed roller pair 144. However, in the pile of sheets S on the processing tray 142, the edge of each intermediate sheet S protrudes toward the regulating member 143 beyond the edges of the uppermost and lowermost sheets S. This ensures that each intermediate sheet S is moved until its edge reaches the regulating member 143, despite the force applied by the feed roller pair 144 acting less on the intermediate sheets S than on the uppermost and lowermost sheets S. In addition, each roller in the feed roller pair 144 is a spongy elastic member. This effectively prevents the edge of an intermediate sheet S from being creased, even if the feed roller pair 144 continues to move the uppermost and lowermost sheets S after the edge of the intermediate sheet S abuts against the regulating member 143.

Figure 2:
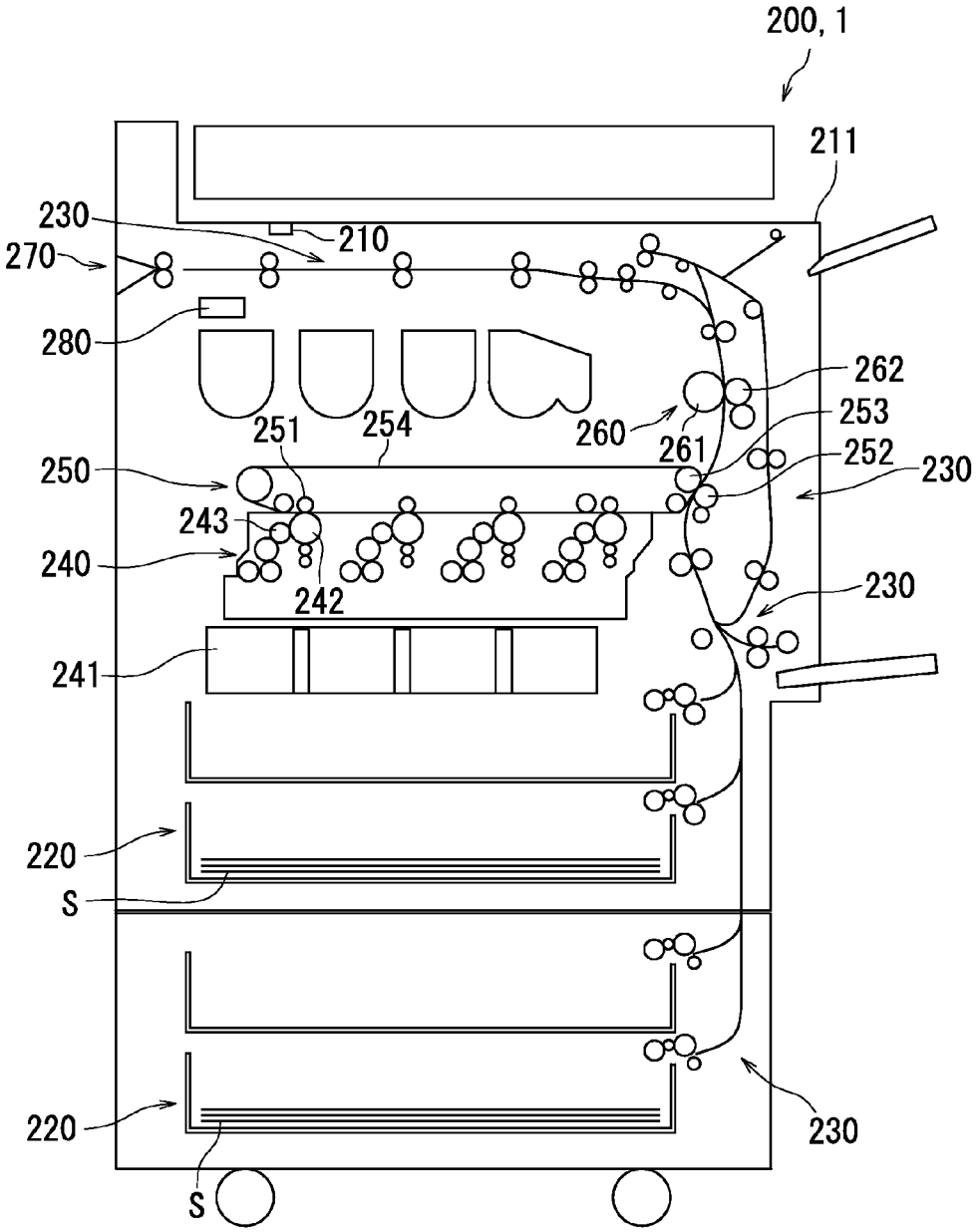
FIG. 2 is a schematic diagram of a main body of the image forming apparatus according to the embodiments of the present disclosure.

The following now describes the image forming apparatus 1 according to Embodiment 1 of the present disclosure. First, the main body 200 of the image forming apparatus 1 is described with reference to FIG. 2. FIG. 2 is a schematic diagram of the main body 200 of the image forming apparatus 1.

The main body 200 includes a document reading section 210, a paper feed section 220, a conveyance section 230, an imaging section 240, a transfer section 250, a fixing section 260, an ejection section 270, and a control section 280.

The document reading section 210 reads an image of a document placed on a document table 211 to generate image data.

The paper feed section 220 is located at the bottom of the main body 200. The paper feed section 220 can store a plurality of sheets S and feeds sheets S one by one to the conveyance section 230.

The conveyance section 230 conveys a sheet S fed by the paper feed section 220 sequentially to the transfer section 250, the fixing section 260, and the ejection section 270.

The imaging section 240 forms a toner image based on image data generated by the document reading section 210. The imaging section 240 includes an exposure device 241, a plurality of photosensitive drums 242, and a plurality of development rollers 243.

The exposure device 241 scans each photosensitive drum 242 with a laser beam based on the image data. Through the laser beam scanning, an electrostatic latent image is formed on the photosensitive drum 242. Each development roller 243 supplies toner to a corresponding photosensitive drum 242 so as to develop the electrostatic latent image. As a result of the development, a toner image is formed on each photosensitive drum 242.

The transfer section 250 includes a plurality of primary transfer rollers 251, a secondary transfer roller 252, a driven roller 253, and an intermediate transfer belt 254. The transfer section 250 transfers the toner images formed on the respective photosensitive drums 242 to the intermediate transfer belt 254 so as to overlay the toner images. The overlaid toner images are transferred from the intermediate transfer belt 254 to a sheet S.

Each primary transfer roller 251 is located opposite to a corresponding photosensitive drum 242 with the intermediate transfer belt 254 therebetween. The primary transfer rollers 251 press the intermediate transfer belt 254 against the respective photosensitive drums 242. With this configuration, the toner images formed on the photosensitive drums 242 are transferred to be overlaid on the intermediate transfer belt 254.

The secondary transfer roller 252 is pressed against the driven roller 253. Consequently, a nip is formed between the secondary transfer roller 252 and the driven roller 253. When a sheet S passes through the nip, the secondary transfer roller 252 and the driven roller 253 cause the toner image to be transferred from the intermediate transfer belt 254 to the sheet S.

The fixing section 260 includes a fixing member 261 and a pressure member 262. The fixing section 260 applies heat and pressure to a sheet S to fix an unfixed toner image which has been transferred to the sheet S by the transfer section 250.

The ejection section 270 ejects a sheet S having a fixed toner image to outside of the main body 200.

The control section 280 has a storage area for storing data such as programs and setting information. The storage area is implemented by random access memory (RAM) and read only memory (ROM). The control section 280 controls the overall operation of the image forming apparatus 1 by executing different control programs stored in advance in the storage area.

Figure 3:
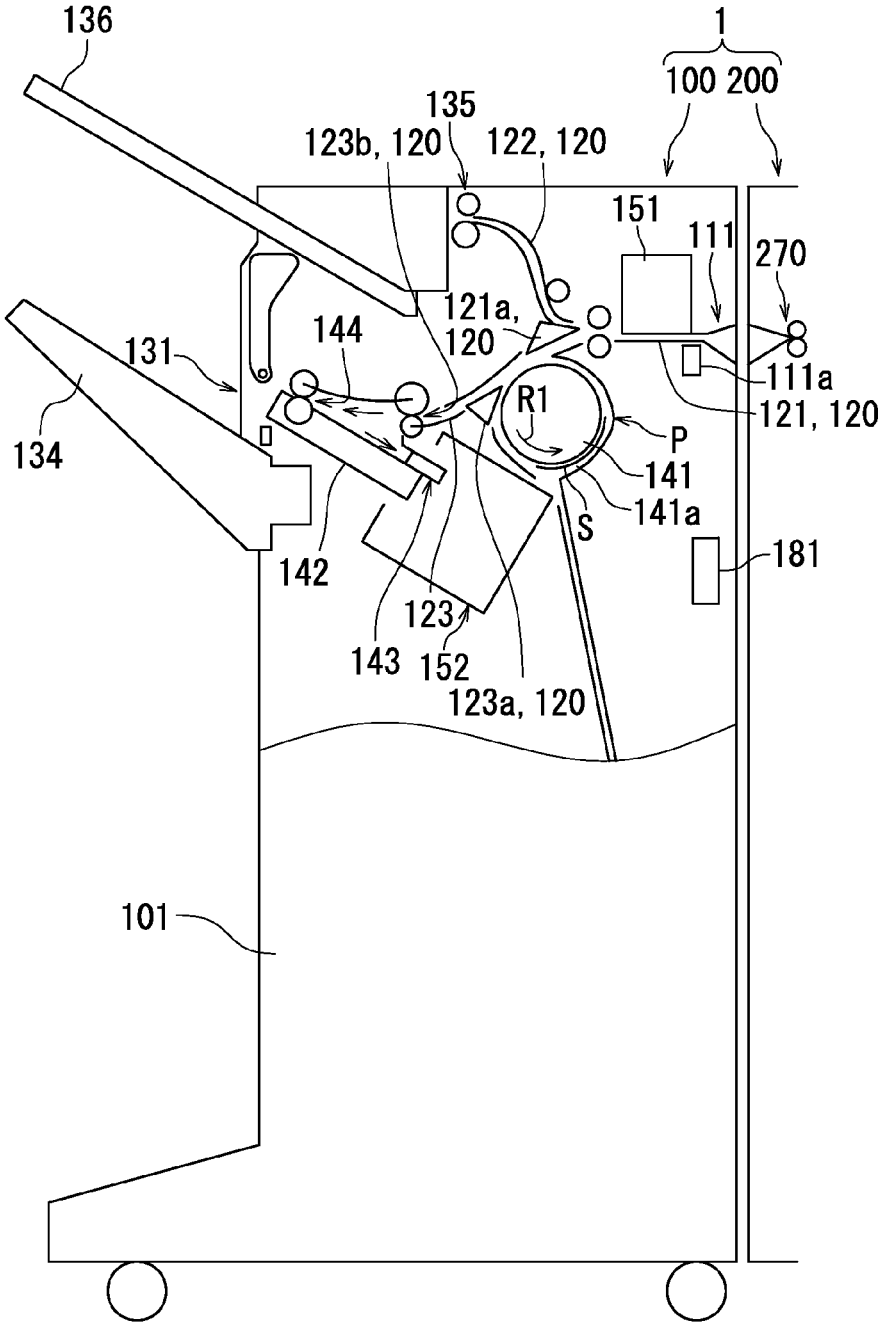
FIG. 3 is a schematic diagram of major parts of the sheet post-processing device according to the embodiments of the present disclosure.
Figure 4:
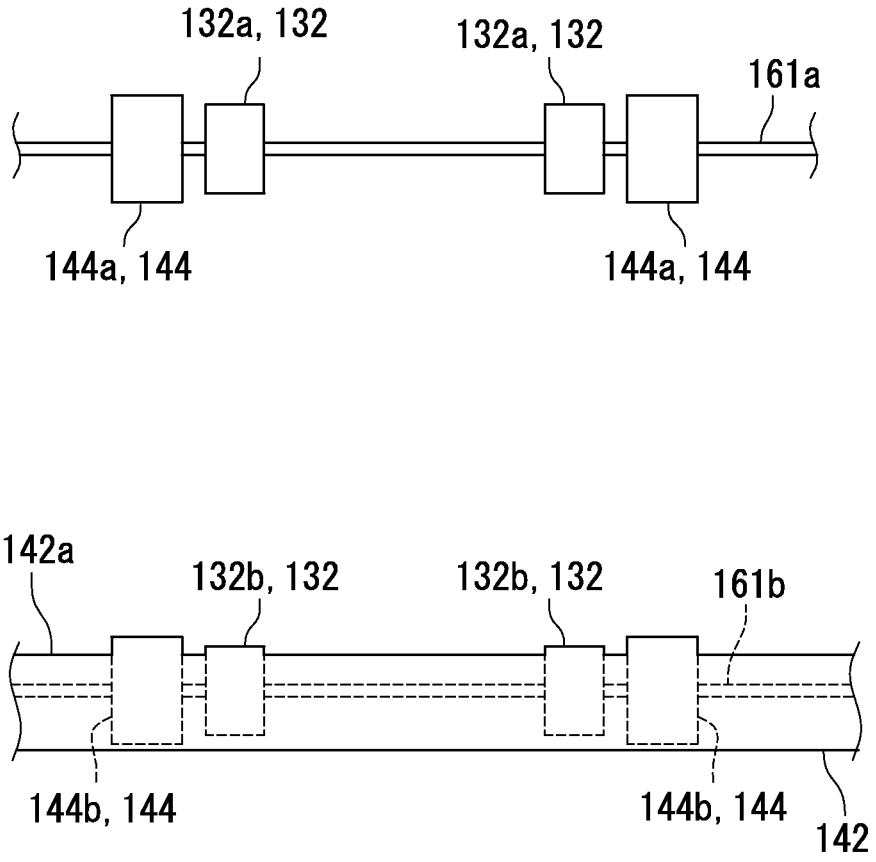
FIG. 4 is a schematic diagram of feed rollers and ejection rollers according to the embodiments of the present disclosure.

With reference to FIGS. 3, 4, 5A, and 5B, the following now describes the sheet post-processing device 100 in detail. FIG. 3 is a schematic diagram of major parts of the sheet post-processing device 100. FIG. 4 is a schematic diagram of two feed roller pairs 144 and two ejection roller pairs 132. Sheets S ejected from the main body 200 through the ejection section 270 are sequentially fed into a housing 101 of the sheet post-processing device 100. The sheet post-processing device 100 performs post-processing of sheets, such as stapling, offsetting, and hole punching, on the sheets S.

As shown in FIG. 3, the sheet post-processing device 100 includes the housing 101 roughly having a box shape, an entrance section 111, a first ejection section 131, a first ejection tray 134, a second ejection section 135, and a second ejection tray 136. The sheet post-processing device 100 additionally includes a puncher 151, a stapler 152, and a controller 181.

The entrance section 111 receives a sheet S having an image printed by the main body 200 of the image forming apparatus 1.

The conveyance section 120 includes a first conveyance section 121, a second conveyance section 122, and a third conveyance section 123.

The first conveyance section 121 extends from the entrance section 111 to a first branching member 121*a*. The first branching member 121*a* is rotatably supported. A sheet S conveyed by the first conveyance section 121 is selectively fed into the second conveyance section 122 or the third conveyance section 123 by the first branching member 121*a*.

The second conveyance section 122 extending from the first branching member 121*a* to the second ejection section 135 conveys a sheet S to the second ejection section 135. The second ejection tray 136 receives sheets S ejected through the second ejection section 135.

The third conveyance section 123 extends from the first branching member 121*a* to the processing tray 142. The third conveyance section 123 includes a second branching member 123*a* and an intermediate roller pair 123*b*. A sheet S conveyed to the third conveyance section 123 is moved by the intermediate roller pair 123*b* onto the processing tray 142. The stapler 152 performs stapling (one example of post-processing) of a plurality of sheets S on the processing tray 142. The plurality of sheets S stapled together are ejected by the first ejection section 131 onto the first ejection tray 134.

The evacuating member 141 rotates in a rotation direction R1 shown in FIG. 3 in accordance with the direction of conveyance by the third conveyance section 123. An evacuation path 141*a* is formed between the circumferential surface of the evacuating member 141 and a guide member located opposite to the circumferential surface. As the evacuating member 141 rotates in the rotation direction R1, the sheet S conveyed to the third conveyance section 123 wraps around the circumferential surface of the evacuating member 141.

More specifically, to evacuate a sheet S from the third conveyance section 123, the second branching member 123*a* is rotated to a position for forwarding sheets S into the evacuation path 141*a* as the sheet S is conveyed thereto in the third conveyance section 123. As a result, the sheet S conveyed to the third conveyance section 123 is evacuated into the evacuation path 141*a*. The evacuation path 141*a* is provided with conveyance rollers. Each conveyance roller is located opposite to the circumferential surface of the evacuating member 141. The sheet S fed into the evacuation path 141*a* is nipped between the evacuating member 141 and each of the conveyance rollers to be moved in the rotation direction R1 of the evacuating member 141. As a result, the sheet S wraps around the circumferential surface of the evacuating member 141.

The second branching member 123*a* is rotated back to the initial position after the first ejection section 131 conveys a preceding sheet S having been subjected to post-processing from the processing tray 142 to the first ejection tray 134. Consequently, a subsequent sheet S having been held in standby in the evacuation path 141*a* is conveyed through the third conveyance section 123 onto the processing tray 142.

When evacuating a plurality of sheets S and holding them in standby, the evacuating member 141 stacks the plurality of sheets S into a pile. In other words, the sheets S wrap around the circumferential surface of the evacuating member 141 in layers. The pile of evacuated sheets S is conveyed to the processing tray 142 after preceding sheets S on the processing tray 142 are subjected to post-processing and moved to the first ejection tray 134.

More specifically, during the time a plurality of sheets S on the processing tray 142 are aligned, stapled, and ejected onto the first ejection tray 134, subsequent sheets S fed into the third conveyance section 123 are sequentially evacuated by the evacuating member 141 and stacked into a pile in the evacuation path 141*a*.

The puncher 151 is located upstream from the first branching member 121*a* in the conveyance path of sheets S. The puncher 151 performs hole punching with predetermined timing on sheets S conveyed by the first conveyance section 121. The second conveyance section 122 is for conveying sheets S that are not to be subjected to post-processing or are only to be subjected to hole punching.

The stapler 152 staples sheets S having aligned edges with a staple. After the stapler 152 staples the sheets S, the first ejection section 131 ejects the stapled sheets S onto the first ejection tray 134.

The controller 181 controls operation of each part of the sheet post-processing device 100 according to a request from the control section 280 of the main body 200 (see FIG. 2).

Reference is now made to FIG. 4 to describe the feed roller pairs 144 and the ejection roller pairs 132. The ejection roller pairs 132 are included in the first ejection section 131. FIG. 4 is a schematic diagram of the feed roller pairs 144 and the ejection roller pairs 132 according to Embodiment 1 of the present disclosure. Note that FIG. 4 shows the processing tray 142 seen from the side of the first ejection tray 134.

As shown in FIG. 4, each feed roller pair 144 includes a first feed roller 144*a* and a second feed roller 144*b*. In the present embodiment, each of the rollers 144*a* and 144*b* in the respective feed roller pairs 144 is a spongy roller having a layer of elastomeric foam (an example of a spongy elastomeric member). The sheet post-processing device 100 also includes a first support shaft 161*a* and a second support shaft 161*b*. The first feed rollers 144*a* are attached to the first support shaft 161*a* and rotate in accordance with the rotation of the first support shaft 161*a*. The second feed rollers 144*b* are attached to the second support shaft 161*b*, which is embedded in the processing tray 142, and rotate in accordance with the rotation of the second support shaft 161*b*. Each second feed roller 144*b* has a circumferential surface partially exposed above a sheet placement surface 142*a* of the processing tray 142. Therefore, each second feed roller 144*b* abuts against a corresponding one of the first feed rollers 144*a* with a conveyed sheet S sandwiched therebetween.

Each ejection roller pair 132 includes a first ejection roller 132*a* and a second ejection roller 132*b*. In the present embodiment, each of the rollers 132*a* and 132*b* in the ejection roller pairs 132 are made of rubber and are smaller in diameter than the rollers 144*a* and 144*b* in the feed roller pairs 144. The first ejection rollers 132*a* are attached to the first support shaft 161*a* at positions axially inward from the first feed rollers 144*a*. The first ejection rollers 132*a* rotate in accordance with the rotation of the first support shaft 161*a*. The second ejection rollers 132*b* are attached to the second support shaft 161*b* at positions axially inward from the second feed rollers 144*b*. The second ejection rollers 132*b* rotate in accordance with the rotation of the second support shaft 161*b*. Each second ejection roller 132*b* has a circumferential surface partially exposed to protrude beyond the sheet placement surface 142*a* of the processing tray 142. Therefore, each second ejection roller 132*b* abuts against a corresponding one of the first ejection rollers 132*a* with a conveyed sheet S sandwiched therebetween.

The first support shaft 161*a* is movable toward and away from the second support shaft 161*b*. When a pile of sheets S is conveyed from the third conveyance section 123 onto the processing tray 142, the first support shaft 161*a* is moved to a position closer to the second support shaft 161*b*. More specifically, the first support shaft 161*a* is moved toward the second support shaft 161*b* such that the sheet pile is nipped between the first ejection roller 132*a* and the second ejection roller 132*b*. Since the first support shaft 161*a* and the second support shaft 161*b* are being rotated, the leading edge of the sheet pile is nipped by the ejection roller pairs 132 and conveyed toward the first ejection tray 134. The rollers 144*a* and 144*b* in the feed roller pairs 144 at this time are partially compressed.

As the leading edge of the sheet pile is conveyed toward the first ejection tray 134, the trailing edge of the sheet pile eventually drops onto the processing tray 142 from the third conveyance section 123. When the trailing edge of the sheet pile being conveyed reaches such a position, each ejection roller pair 132 stops rotating. In one example, the third conveyance section 123 may be provided with a detection sensor in order to stop the rotation of the ejection roller pairs 132 with appropriate timing. That is, output of the detection sensor may be used to detect that the trailing edge of the sheet pile has reached a position to be dropped from the third conveyance section 123 onto the processing tray 142. Alternatively, the controller 181 may be provided with a function of measuring a time period starting when the second branching member 123*a* is rotated back to the initial position. That is, the measured time period may be used to detect that the trailing edge of the sheet pile has reached the position to be dropped from the third conveyance section 123 onto the processing tray 142.

Subsequently, the first support shaft 161*a* moves away from the second support shaft 161*b*. More specifically, the first support shaft 161*a* moves away from the second support shaft 161*b* to a position where the nip formed by the respective ejection roller pairs 132 is released while the feed roller pairs 144 still nip the sheet pile.

According to the present embodiment, each of the rollers 144*a* and the 144*b* in the feed roller pairs 144 is larger in diameter than each of the rollers 132*a* and 132*b* in the ejection roller pairs 132. Therefore, as the first support shaft 161*a* moves away from the second support shaft 161*b*, the nip formed by the respective ejection roller pairs 132 is released before the nip formed by the respective feed roller pairs 144 is released. When the first support shaft 161*a* is moved away from the second support shaft 161*b* to a position where only the nip formed by the ejection roller pairs 132 is released, the first and second support shafts 161*a* and 161*b* start to rotate in reverse to the rotation direction that is for conveying a sheet pile to the first ejection tray 134.

As a result, the sheet pile is moved toward the regulating member 143 only by the feed roller pairs 144. For conveying sheets S from the processing tray 142 to the first ejection tray 134 after post-processing, the first support shaft 161*a* moves toward the second support shaft 161*b*. More specifically, the first support shaft 161*a* moves toward the second support shaft 161*b* to a position where the respective ejection roller pairs 132 can nip the sheets S on the processing tray 142. Then, the first and second support shafts 161*a* and 161*b* rotate in reverse to the rotation direction for moving a sheet pile toward the regulating member 143. As a result, the sheets S after post-processing are nipped by the respective feed roller pairs 144 as well as the ejection roller pairs 132 and conveyed to the first ejection tray 134.

Figure 5A:
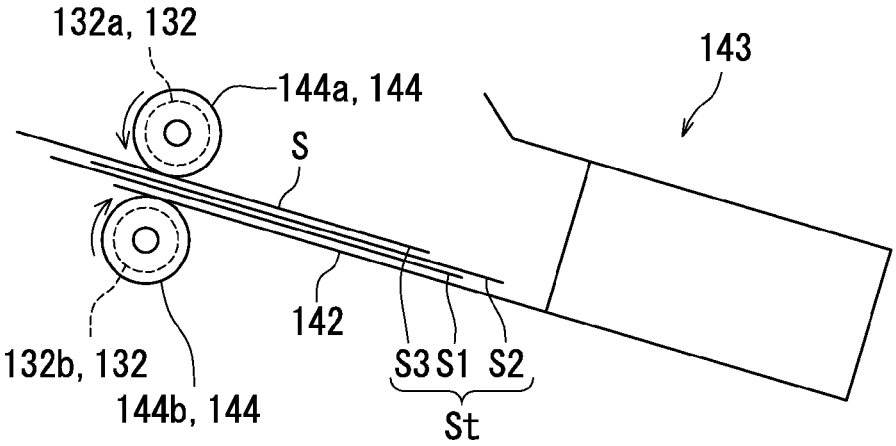
FIG. 5A is a schematic diagram of a pile of sheets according to Embodiment 1 of the present disclosure.
Figure 5B:
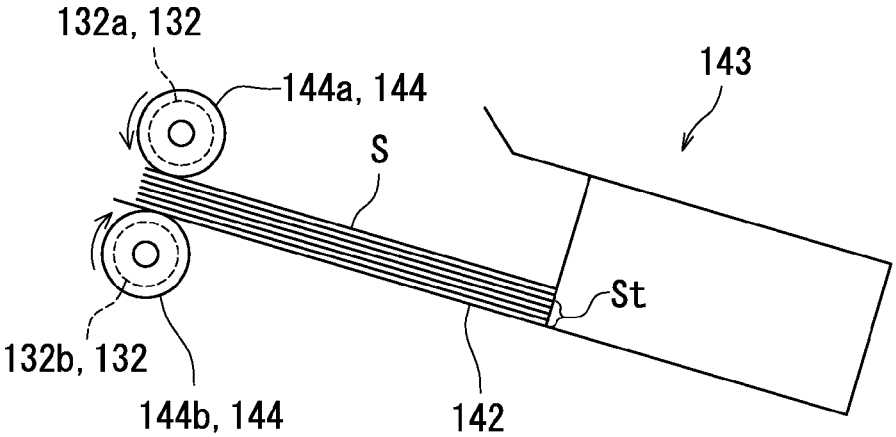
FIG. 5B is another schematic diagram of a pile of sheets according to Embodiment 1 of the present disclosure.

With reference to FIGS. 3, 5A, and 5B, the following now describes an example in which the evacuating member 141 evacuates three sheets S. FIG. 5A shows the state where a pile St of sheets S on the processing tray 142 is moved by the feed roller pairs 144 toward the regulating member 143. FIG. 5B shows the state where a plurality of (three or more) sheets S in the sheet pile St abut against the regulating member 143.

As shown in FIGS. 3, 5A, and 5B, when evacuating three sheets S, the evacuating member 141 sequentially stacks the sheets S into a sheet pile St in order of entry into the evacuation path 141*a*. Thus, the first one of the sheets S fed into the evacuation path 141*a* will be the lowermost sheet S1, which is located lowest in the sheet pile St on the processing tray 142. The second one of the sheets S fed into the evacuation path 141*a* will be the intermediate sheet S, which is located between the top and the bottom in the sheet pile St on the processing tray 142. The third one of the sheets S fed into the evacuation path 141*a* will be the uppermost sheet S3, which is located highest in the sheet pile St on the processing tray 142. The evacuating member 141 stacks the sheets S into the sheet pile St such that an edge of the intermediate sheet S2 protrudes beyond edges of the uppermost and lowermost sheets S3 and S1 toward the regulating member 143 in a state where the sheet pile St is on the processing tray 142.

For example, when a sheet S, which will be the lowermost sheet S1, is fed into the evacuation path 141*a*, the evacuating member 141 conveys the lowermost sheet S1 along the evacuation path 141*a*. When the leading edge (the edge at the front of the sheet S in the conveyance direction) reaches a stop position P, the evacuating member 141 stops rotating. The evacuating member 141 resumes the conveyance of the lowermost sheet S1 a predetermined time period after a sheet-passage sensor 111*a* disposed in the entrance section 111 detects passage of a subsequent sheet S, which will be the intermediate sheet S2. Through the above operation, the intermediate sheet S2 is stacked on the lowermost sheet S1 such that one edge (the trailing edge) of the intermediate sheet S2 protrudes beyond one edge (the trailing edge) of the lowermost sheet S1. A subsequent sheet S, which will be the uppermost sheet S3, is stacked on the intermediate sheet S2 such that one edge (the trailing edge) of the intermediate sheet S2 protrudes beyond the one edge (the trailing edge) of the uppermost sheet S3. Consequently, the three sheets S are stacked into the sheet pile St in a manner that the aforementioned one edge of the intermediate sheet S2 protrudes toward the regulating member 143 beyond the respective edges of the uppermost sheet S3 and the lowermost sheet S1.

The sheet pile St produced by the evacuating member 141 is conveyed onto the processing tray 142 through the third conveyance section 123. Then, the sheet pile St is moved toward the regulating member 143 by the feed rollers 144*a* and 144*b* each rotating in the direction of an arrow shown in FIGS. 5A and 5B. As the sheet pile St is moved, the intermediate sheet S2 abuts against the regulating member 143 first and then the lowermost and uppermost sheets S1 and S3 abut against the regulating member 143. Consequently, the edges of sheets S in the sheet pile St are aligned.

When a subsequent sheet S is to be stacked on the sheet pile St that is on the processing tray 142, the first support shaft 161*a* moves (ascends) to move the first feed rollers 144*a* away from the second feed rollers 144*b*. The subsequent sheet S then drops onto the processing tray 142 to be stacked on the sheet pile St. Then, the first support shaft 161*a* moves (descends) toward the second support shaft 161*b* to cause each feed roller pair 144 to form a nip. Then, the first and second support shafts 161*a* and 161*b* rotate and thus the feed roller pairs 144 move the subsequent sheet S toward the regulating member 143. Consequently, the edges of all the sheets S in the sheet pile St, including the subsequent sheet S, are aligned as shown in FIG. 5B. The aligned sheets S are stapled, for example, and then ejected to the ejection tray 134 by the ejection roller pairs 132.

As has been described with reference to FIGS. 1 to 5A and 5B, when evacuating three sheets S, the evacuating member 141 stacks the three sheets S into a sheet pile St such that an edge of the intermediate sheet S2 protrudes toward the regulating member 143 in a state where the sheet pile St is on the processing tray 142. Such stacking ensures that when the sheet pile St is moved toward the regulating member 143, the intermediate sheet S2 abuts against the regulating member 143 first and then the lowermost and uppermost sheets S1 and S2 abut against the regulating member 143. Consequently, the edges of all the sheets S in the sheet pile St are aligned.

The rollers 144*a* and 144*b* in the feed roller pairs 144 are spongy rollers each having a layer of elastic foam. Thus, Expression 1 is satisfied when the feed roller pairs 144 move the sheet pile St toward the regulating member 143.

$$\text{Friction Force } Fa > \text{Sheet Creasing Force} > \text{Friction Force } Fb \qquad \text{Expression 1}$$

In Expression 1, Fa denotes a friction force applied to a sheet S by each of the rollers 144*a* and 144*b* in the feed roller pairs 144, Sheet Creasing Force denotes a force causing creasing of a sheet S, and Fb denotes a friction force arising between adjacent sheets S by the nip produced by each feed roller pair 144.

As long as Expression 1 is satisfied, each intermediate sheet S is less likely to be creased when the uppermost and lowermost sheets S are continued to be moved toward the regulating member 143 after the edge of an intermediate sheet S abuts against the regulating member 143. This is because the use of spongy feed rollers 144*a* and 144*b* ensures that the force applied to the intermediate sheet S2 by each of the rollers 144*a* and 144*b* once the intermediate sheet S2 abuts against the regulating member 143 at an edge does not exceed the stiffness of the intermediate sheet S2 (the force required to cause creasing of the intermediate sheet S2). Consequently, occurrence of creasing of the intermediate sheet S2 is reduced.

Embodiment 2

Figure 6:
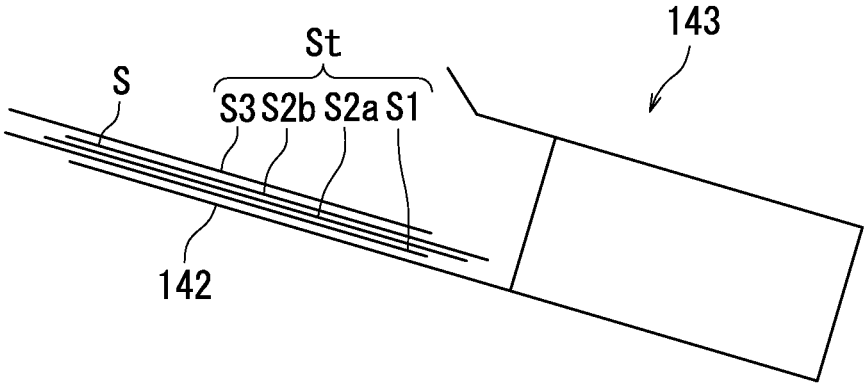
FIG. 6 is a schematic diagram of a pile of sheets according Embodiment 2 of the present disclosure.
Figure 7:
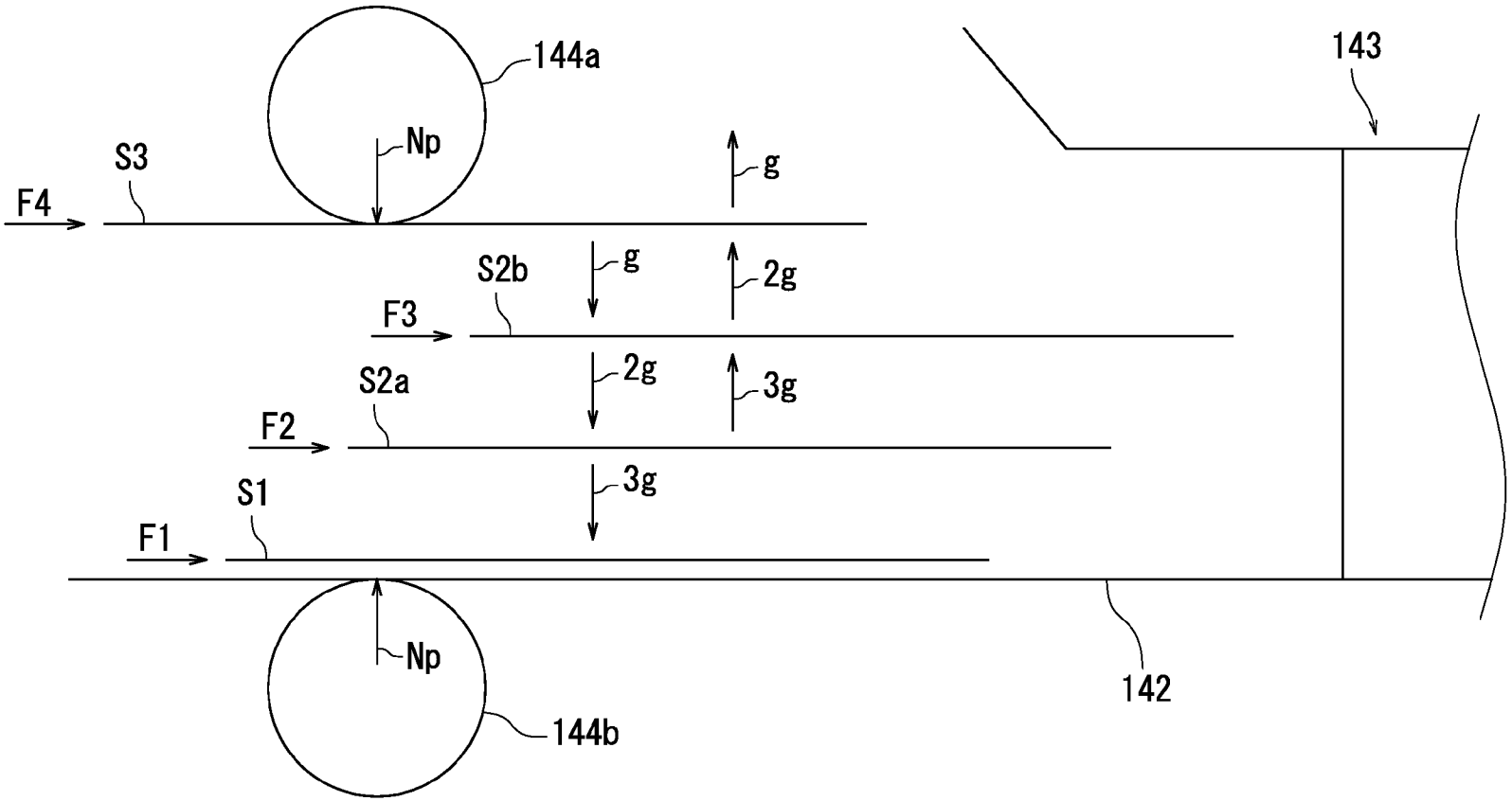
FIG. 7 illustrates the forces acting on a pile of sheets according to Embodiment 2.

The following describes the sheet post-processing device 100 according to Embodiment 2 of the present disclosure with reference to FIGS. 3, 6, and 7. In Embodiment 2, the evacuating member 141 evacuates four sheets S. The following description focuses on differences with Embodiment 1 and no overlapping description is given. FIG. 6 shows a state where a pile of four sheets S is on the processing tray 142. FIG. 7 illustrates the forces acting on the four sheets S on the processing tray 142.

The evacuating member 141 shown in FIG. 3 can stack four sheets S into a sheet pile St. As shown in FIG. 6, the first one of the four sheets S fed into the evacuation path 141*a* will be a lowermost sheet S1, which is at the bottom of the sheet pile St on the processing tray 142. The last one of the four sheets S fed into the evacuation path 141*a* will be an uppermost sheet S3, which is at the top of the sheet pile St on the processing tray 142. The second one of the four sheets S fed into the evacuation path 141*a* will be a first intermediate sheet S2*a*, which is on the lowermost sheet S1, and the third one will be a second intermediate sheet S2*b*, which is on the first intermediate sheet S2*a* and immediately below the uppermost sheet S3. The first and second intermediate sheets S2*a* and S2*b* are stacked such that the edge of each intermediate sheet increasingly protrudes toward the regulating member 143 in order of an increasing distance from the processing tray 142.

Similarly to the example of stacking three sheets, when a sheet S, which will be the lowermost sheet S1, is fed into the evacuation path 141*a*, the evacuating member 141 conveys the lowermost sheet S1 along the evacuation path 141*a*. When the leading edge of the lowermost sheet S1 (the edge at the front of the sheet S in the conveyance direction) reaches the stop position P, the evacuating member 141 stops rotating. The evacuating member 141 resumes the conveyance of the lowermost sheet S1 a predetermined time period after the sheet-passage sensor 111*a* detects passage of a subsequent sheet S, which will be the first intermediate sheet S2*a*. Through the above operation, the first intermediate sheet S2*a* is stacked on the lowermost sheet S1 such that one edge (the trailing edge) of the first intermediate sheet S2*a* protrudes beyond one edge (the trailing edge) of the lowermost sheet S1. A subsequent sheet S, which will be the second intermediate sheet S2*b*, is stacked on the first intermediate sheet S2*a* in a similar manner that one edge (the trailing edge) of the second intermediate sheet S2*b* protrudes beyond one edge (the trailing edge) of the first intermediate sheet S2*a*. A subsequent sheet S, which will be the uppermost sheet S3, is stacked on the second intermediate sheet S2*b* such that one edge (the trailing edge) of the second intermediate sheet S2*b* protrudes beyond one edge (the trailing edge) of the uppermost sheet S3. Consequently, the first and second intermediate sheets S2*a* and S2*b* are stacked such that the edges of the intermediate sheets protrude toward the regulating member 143 more and more in order of an increasing distance from the processing tray 142.

According to the present embodiment, the nip pressure Np of each feed roller pair 144, the friction coefficient μS between a sheet S and each of the feed rollers 144*a* and 144*b* in the feed roller pair 144, the friction coefficient μP between adjacent sheets S, and the weight g of a sheet S need to satisfy Expression 2 below.

$$\mu S \times Np > \mu P \times (Np+g) \qquad \text{Expression 2}$$

Therefore, the nip pressure Np of each feed roller pair 144 as well as the material of each of the feed rollers 144*a* and 144*b* is selected so as to satisfy Expression 2.

Once the respective feed roller pairs 144 starts rotating with the sheet pile St sandwiched therebetween, the forces F4 to F1 respectively given by Expressions 3 to 6 act on the respective sheets S in the sheet pile St as shown in FIG. 7. More specifically, the force F4 acts on the sheet S3, the force F3 acts on the sheet S2*b*, the force F2 acts on the sheet S2*a*, and the force F1 acts on the sheet S1.

$$F4 = \mu S \times Np + \mu P \times (Np+g) \qquad \text{Expression 3}$$

$$F3 = \mu P \times (Np+g) + \mu P \times (Np+2g) \qquad \text{Expression 4}$$

$$F2 = \mu P \times (Np+2g) + \mu P \times (Np+3g) \qquad \text{Expression 5}$$

$$F1 = \mu P \times (Np+3g) + \mu S \times (Np+4g) \qquad \text{Expression 6}$$

In Expressions 3 to 5 above, F1 denotes the force applied to the lowermost sheet S1, F2 to the first intermediate sheet S2*a*, F3 to the second intermediate sheet S2*b*, and F4 to the uppermost sheet S3.

As described above, the second intermediate sheet S2*b* protrudes toward the regulating member 143 most among all of the sheets S in the sheet pile St. Thus, the second intermediate sheet S2*b* reaches the regulating member 143 first among the sheets S in the sheet pile St. Once the second intermediate sheet S2*b* reaches the regulating member 143, the forces F4, F2, and F1 respectively given by Expressions 7 to 9 are applied to the other sheets S in the sheet pile St. More specifically, the force F4 is applied to the sheet S3, the force F2 to the sheet S2*a*, and the force F1 to sheet S1.

$$F4=\mu S\times Np-\mu P\times(Np+g) \quad \text{Expression 7}$$

$$F2=\mu P\times(Np+3g)-\mu P\times(Np+2g)=\mu P\times g \quad \text{Expression 8}$$

$$F1=\mu S\times(Np+4g)-\mu P\times(Np+3g) \quad \text{Expression 9}$$

Based on Expression 2 above, F4>0 is satisfied in Expression 7, and F1>0 is satisfied in Expression 9. In addition, F2>0 is satisfied in Expression 8. Since force F continues to act on the sheets S3, S2*a*, and S1 in the sheet pile St in a direction toward the regulating member 143, the sheets S3, S2*a*, and S1 continue to move toward the regulating member 143.

Once the first intermediate sheet S2*a* has reached the regulating member 143, the forces F4 and F1, which are respectively equal to the forces F4 and F1 given by Expressions 7 and 9 above, are applied to the other sheets S3 and S1. Since the force F continues to act on the sheets S3 and S1 in a direction toward the regulating member 143, the sheets S3 and S1 continue to move toward the regulating member 143.

As a result, the edges of the four sheets S (S1, S2*a*, S2*b*, and S3) included in the sheet pile St all abut against the regulating member 143 and thus align.

The present embodiment is described through an example in which four sheets S are evacuated. However, the number of sheets to be evacuated is not limited to four and may be five or more.

The above has described the embodiments of the present disclosure with reference to the accompanying drawings (FIGS. 1 to 7). However, the present disclosure is not limited to the embodiments described above and may be practiced through different variations without departing from the essence of the present disclosure.

Figure 8A:
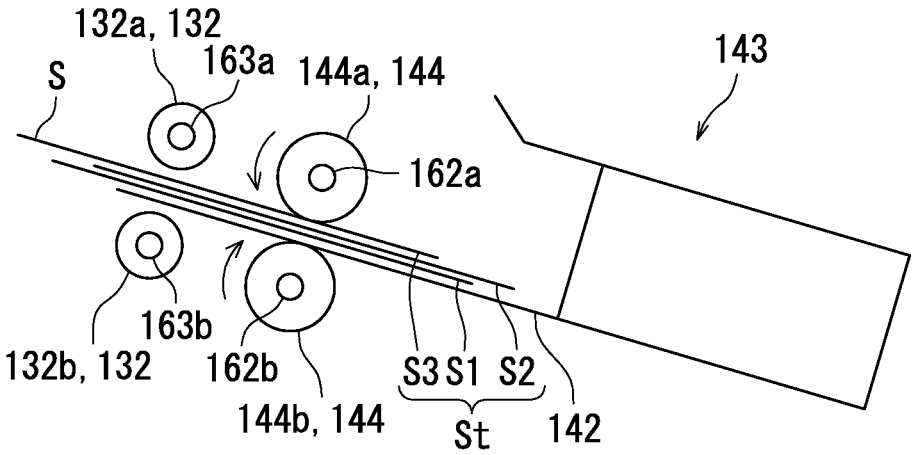
FIG. 8A is a schematic diagram of feed rollers and ejection rollers according to a variation of the present disclosure.
Figure 8B:
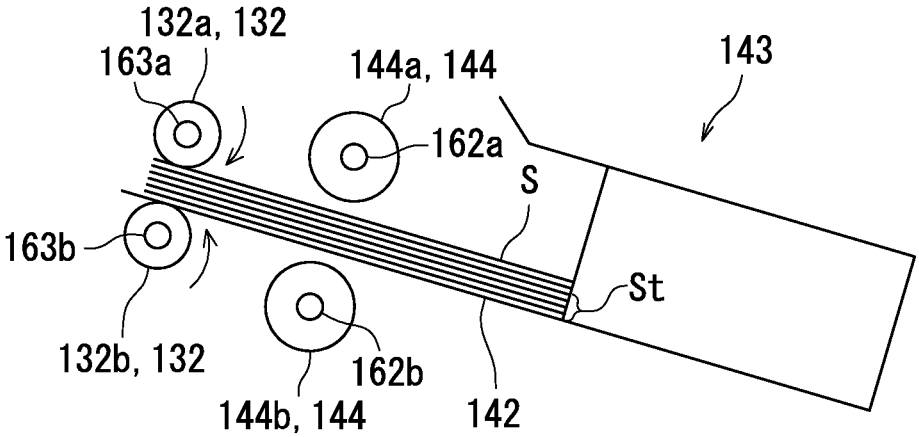
FIG. 8B is a schematic diagram of a different state of the feed rollers and the ejection rollers according to the variation of the present disclosure.

For example, according to the embodiments described above, the first feed rollers 144*a* are coaxial with the first ejection rollers 132*a*, whereas the second feed rollers 144*b* are coaxial with the second ejection rollers 132*b*. However, the present disclosure is not limited to this configuration. For example, as shown in FIGS. 8A and 8B, the first feed rollers 144*a* and the first ejection rollers 132*a* may have mutually different axes, and the second feed rollers 144*b* and the second ejection rollers 132*b* may have mutually different axes. More specifically, the first feed rollers 144*a* are attached to a third support shaft 162*a*, and the second feed rollers 144*b* are attached to a fourth support shaft 162*b*. The first ejection rollers 132*a* are attached to a fifth support shaft 163*a*, and the second ejection rollers 132*b* are attached to a sixth support shaft 163*b*. The third support shaft 162*a* is movable toward and away from the fourth support shaft 162*b*. Similarly, the fifth support shaft 163*a* is movable toward and away from the sixth support shaft 163*b*. The third and fourth support shafts 162*a* and 162*b* are located toward the regulating member 143 relative to the fifth and sixth support shafts 163*a* and 163*b*. That is, the feed roller pairs 144 are located closer to the regulating member 143 than the ejection roller pairs 132 are to the regulating member 143. The feed first rollers 144*a* may be attached at positions axially inward or outward from the first ejection rollers 132*a*, whereas the second feed rollers 144*b* may be attached at positions axially inward or outward from the second ejection rollers 132*b*.

The feed roller pairs 144 and the ejection roller pairs 132 operate in the same manner as in Embodiment 1. In short, as shown in FIG. 8A, to forward a sheet pile St to the regulating member 143, the fifth support shaft 163*a* moves away from the sixth support shaft 163*b* and the third support shaft 162*a* moves toward the fourth support shaft 162*b*. More specifically, the third to sixth support shafts 162*a*, 162*b*, 163*a*, and 163*b* are moved to positions such that the sheet pile St is nipped only between each first feed roller 144*a* and the corresponding second feed roller 144*b*. Then, through rotation of the feed roller pairs 144, the sheet pile St is moved toward the regulating member 143. In short, the sheet pile St is moved only by the feed roller pairs 144 in the direction toward the regulating member 143. As has been described above, each of the feed rollers 144*a* and 144*b* has a layer of elastomeric foam. This reduces occurrence of creasing of the sheets S.

When the sheet pile St is conveyed toward the first ejection tray 134, the third support shaft 162*a* moves away from the fourth support shaft 162*b* and the fifth support shaft 163*a* moves toward the support shaft 163*b*, as shown in FIG. 8B. More specifically, the third to sixth support shafts 162*a*, 162*b*, 163*a*, and 163*b* are moved to the positions such that the sheet pile St is nipped only between each first ejection roller 132*a* and the corresponding second ejection rollers 132*b*. Through the rotation of the ejection roller pairs 132, the sheet pile St is conveyed toward the first ejection tray 134.

According to the embodiments described above, each of the feed rollers 144*a* and 144*b* has a layer of elastomeric foam. However, this is only an example and the feed rollers 144*a* and 144*b* are not limited to such a configuration. For example, the feed rollers 144*a* and 144*b* may be any rollers that are more pliable than the ejection rollers 132*a* and 132*b* made of rubber, and that have a lower friction coefficient with a sheet S than that of the rubber-made ejection rollers 132*a* and 133*b* with a sheet S.

According to the embodiments described above, the sheet post-processing device includes two feed roller pairs 144. However, the present disclosure is not limited to such a configuration. For example, the sheet post-processing device may include one feed roller pair 144 or three or more feed roller pairs 144.

Additionally, according to the embodiments described above, the sheet post-processing device includes the two feed roller pairs 144. However, the present disclosure is not limited to such a configuration. For example, a single roller may be used as the feed mechanism.

Additionally, according to the embodiments described above, the sheet post-processing device includes two ejection roller pairs 132. However, the present disclosure is not limited to such a configuration. For example, the sheet post-processing device may include one ejection roller pair 132 or three or more ejection roller pairs 132.

Additionally, according to the embodiments described above, the sheet post-processing device includes two ejection roller pairs 132 for ejection of sheet S onto the first ejection tray 134. However, the present disclosure is not limited to such a configuration. For example, the sheet post-processing device may include a single roller for ejection of sheet S onto the first ejection tray 134.

In the embodiments, the feed roller pairs 144 are described as an example of the feed mechanism. However, the present disclosure is not limited such. For example, the feed mechanism may be a caterpillar mechanism having a spongy elastic member.

According to the embodiments described above, the feed roller pairs 144 are used alone to move a sheet pile St or a sheet S toward the regulating member 143. However, the present disclosure is not limited to such. For example, a paddle may be used in addition to the feed roller pairs 144. In this variation, the sheet pile St is preferably stacked such that an edge of the lowermost sheet S1 protrudes toward the regulating member 143 beyond the edge of the uppermost sheet S3 (see FIG. 5). Stacking sheets S into a sheet pile St in this manner ensures that the lowermost sheet S1 reaches the regulating member 143 before the uppermost sheet S3. After the lowermost sheet S1 reaches the regulating member 143, the paddle is used to move the uppermost sheet S3 toward the regulating member 143. Through the above operation, the edges of all of sheets S in the sheet pile St can reach the regulating member 143 and the edges of the sheets S in the sheet pile St are aligned. When a subsequently fed sheet S is further stacked on the sheet pile St, the paddle may be used to move the subsequent sheet S toward the regulating member 143 after the uppermost sheet S3 reaches the regulating member 143. This ensures that that the edge of the subsequent sheet S reaches the regulating member 143 and the edge of the subsequent sheet S is aligned with the edge of the sheet pile St.

In the embodiments described above, all sheets S printed by and ejected out of an image forming apparatus are fed to the sheet post-processing device 100. However, the present disclosure may be used with an image forming apparatus that selectively feeds sheets S on which post-processing is requested to be performed. In this case, the main body of the image forming apparatus selectively feeds requested sheets S to the sheet post-processing device 100 out of sheets S having been printed.

In the embodiments described above, sheets of paper are used as sheets S. However, other types of sheets S such as resin sheets may be used as sheets S.

Note that the accompanying drawings schematically show the components described above. Thus, the dimensions such as thicknesses and lengths may differ from actual ones for the convenience of preparing the drawings.

What is claimed is:

1. A sheet post-processing device that performs post-processing on printed sheets, the sheet post-processing device comprising:

a tray configured to receive sheets thereon, an evacuating member configured to:

temporarily evacuate, from a conveyance path to an evacuation path, sheets being conveyed, stack the evacuated sheets into a pile, and convey the pile of sheets onto the tray through the conveyance path;

a regulating member mounted on the tray;

a feed mechanism that includes a spongy elastic member and configured to move the pile of sheets along the tray toward the regulating member; and a control section configured to cause the evacuating member to performs stacking of three or more sheets into a pile of sheet, wherein the pile of the three or more sheets includes an uppermost sheet located on top of the pile, a lowermost sheet located in lowest in the pile, and an intermediate sheet located between the uppermost sheet and the lowermost sheet, the control section causes the evacuating member to:

convey the lowermost sheet along the evacuating path when a sheet that is to be the lowermost sheet is conveyed into the evacuation path, stop rotating when a leading edge of the lowermost sheet reaches a stop position P in the evacuation path, resume conveyance of the lowermost sheet after a predetermined time period elapses, and stacks the intermediate sheet on the lowermost sheet such that a trailing edge of the intermediate sheet protrudes beyond a trailing edge of the lowermost sheet, and stack a subsequent sheet that is to be the uppermost sheet on the intermediate sheet such that the trailing edge of the intermediate sheet protrudes beyond a trailing edge of the uppermost sheet, the trailing edge of the intermediate sheet protruding toward the regulating member beyond the trailing edge of the uppermost sheet and the trailing edge of the lowermost sheet in the pile conveyed to the tray, the sheet post-processing device further comprising:

an ejection tray; and an ejection roller pair configured to nip the pile conveyed from the evacuating member and convey the pile toward the ejection tray, wherein the feed mechanism includes a feed roller pair configured to nip the pile on the tray and convey the pile to the regulating member, each roller in the feed roller pair is a spongy elastic member, in conveyance of the pile conveyed from the evacuating member onto the tray, the ejection roller pair nips the pile conveyed from the evacuating member and conveys the pile toward the ejection tray, and stops rotating to release nipping when a trailing edge of the pile reaches a position to be dropped onto the tray, the feed roller pair nips the pile, the feed roller pair still nips the pile when the ejection roller pair releases nipping, and after the ejection roller pair releases the nip, the feed roller pair rotates in an opposite direction to a direction that is for conveying the pile to the ejection tray to move the pile toward the restricting member.

2. The sheet post-processing device according to claim 1, wherein one of each roller in the feed roller pair is coaxial with one of each roller in the ejection roller pair, and the other of each roller in the feed roller pair is coaxial with the other of each roller in the ejection roller pair.

3. The sheet post-processing device according to claim 2, wherein the one of each roller in the feed roller pair is larger in diameter than the one of each roller of the ejection roller pair, and the other of each roller in the feed roller pair is larger in diameter than the other of each roller of the ejection roller pair.

4. The sheet post-processing device according to claim 1, wherein the feed mechanism is located closer to the regulating member than the ejection roller pair is.

5. The sheet post-processing device according to claim 1, wherein the evacuating member performs the stacking such that, in the pile conveyed to the tray, an edge of the lowermost sheet protrudes toward the regulating member beyond an edge of the uppermost sheet.

6. The sheet post-processing device according to claim 1, wherein the intermediate sheet of the pile includes a plurality of intermediate sheets between the uppermost sheet and the lowermost sheet, and edges of the intermediate sheets increasingly protrude toward the regulating member in order of an increasing distance from the tray.

7. An image forming apparatus comprising:

a main body for printing an image on one or more sheets, and the sheet post-processing device according to claim 1, wherein the main body feeds sheets requested to be fed to the sheet post-processing device from among the one or more printed sheets.

* * * * *